US010565906B1

(12) United States Patent
Ivescu et al.

(10) Patent No.: US 10,565,906 B1
(45) Date of Patent: Feb. 18, 2020

(54) MULTI-PANEL PROJECT DISPLAY BOARD WITH FOLD-OUT HEADER AND ATTACHABLE BASE

(71) Applicant: Royal Consumer Products LLC, Norwalk, CT (US)

(72) Inventors: Ana-Maria Ivescu, Norwalk, CT (US); Steven A. Schulman, Norwalk, CT (US)

(73) Assignee: Royal Consumer Products LLC, Norwalk, CT (US)

( * ) Notice: Subject to any disclaimer, the term of this patent is extended or adjusted under 35 U.S.C. 154(b) by 0 days.

(21) Appl. No.: 16/274,087

(22) Filed: Feb. 12, 2019

Related U.S. Application Data

(60) Provisional application No. 62/799,725, filed on Jan. 31, 2019.

(51) Int. Cl.
*G09F 15/00* (2006.01)

(52) U.S. Cl.
CPC ..... *G09F 15/0062* (2013.01)

(58) Field of Classification Search
None
See application file for complete search history.

(56) References Cited

U.S. PATENT DOCUMENTS

| | | | | |
|---|---|---|---|---|
| 2,828,565 | A * | 4/1958 | Goidstein | G09F 1/00 206/45.24 |
| 6,119,875 | A * | 9/2000 | Smith | A47F 5/112 211/195 |
| 8,955,243 | B2 * | 2/2015 | Dashe | G09F 1/06 40/539 |
| 9,782,021 | B2 * | 10/2017 | Shaffer | A47F 5/112 |
| 2005/0086842 | A1 * | 4/2005 | Ternovits | G09F 15/0012 40/539 |
| 2008/0067301 | A1 * | 3/2008 | Moss | A47F 5/112 248/174 |
| 2011/0272457 | A1 * | 11/2011 | Fitzwater | B65D 5/28 229/103 |

* cited by examiner

*Primary Examiner* — Kristina N Junge
(74) *Attorney, Agent, or Firm* — Robert J. Hess; Hess Patent Law Firm

(57) ABSTRACT

A project display board and base. With side panels folded over a central panel of the project display board, an adhesive panel, which adheres to one of the side panels, is detachably connected to one side panel via perforations and another side panel is detachably connected to the base via perforations. After severing both perforations, the side panels are pivoted to diverge relative to the central panel to allow self-standing upright. The base is then connected to the project display board by inserting base projecting inserts through panel slits of the project display board. The base is then folded along its own creases so as to define top and bottom surfaces that are parallel to each other and define a front surface perpendicular to both. The side edges of those top and bottom surfaces are inclined to converge away from the front surface.

19 Claims, 4 Drawing Sheets

MULTI-PANEL PROJECT DISPLAY BOARD WITH FOLD-OUT HEADER AND ATTACHABLE BASE

CROSS-REFERENCE TO RELATED APPLICATIONS

The present application asserts the benefit of priority from U.S. provisional patent application No. 62/799,725, filed Jan. 31, 2019.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of Endeavor to which the Invention Pertains

The multi-panel project display board includes a central panel and two side panels and a fold-out header panel. A separate base is provided that has three projecting inserts that fit into three slots.

2. Description of Information Known to the Inventor, Including References to Specific Documents Related to the Invention, and Specific Problems Involved in the State of Technology that the Invention is Drawn Toward Royal Consumer Products LLC is the assignee of U.S. Pat. Nos. 10,170,024 and 10,163,378 that each disclose a project display board having a central panel and two side panels with an integral header extending from each of the two side panels. Royal Consumer Products LLC is also the assignee of U.S. utility patent application Ser. No. 16/172,336 filed Oct. 26, 2018, which is likewise directed to a project display board having a central panel and two side panels with an integral header. It also has an integral footer and a detachable platform that is placed upon the footer. Royal Consumer Products LLC is also the assignee of U.S. patent application Ser. No. 16/115,114, which is directed to a multi-panel display project board whose panels pivot with creases having beaded portions. Royal Consumer Products LLC is also the assignee of U.S. utility patent application Ser. No. 16/172,336, which is directed to a multi-panel display project board with integral header and footer whose panels pivot and that is equipped with a platform placed on top of the folded-out footer and under the central panel and two inclined transition panels.

In addition, there is US published patent application no. 2005/0086842 also discloses an integral footer at the bottom that pivots to serve as a support brace. The bottom of its side panels each have a pirovtable flap that is bent to help support the project display board to keep it stable.

BRIEF SUMMARY OF THE INVENTION

One aspect of the invention resides in a multi-panel project display board that is in a folded state for shipping purposes and an unfolded state for use as a display in an self-standing, upright manner. The multi-panel project display board includes a plurality of panels separated from each other by respective crease lines.

The plurality of panels includes a central panel, two side panels, a fold-out header panel, a base panel and an adhesive panel. For shipping purposes, One side panel is detachably connected via a intervening perforated line to the adhesive panel. The base panel is detachably connected via a further perforated line to the other side panel. Both the intervening perforated line and the further perforated line are in alignment with each other.

Once the intervening perforated line and the further perforated line that align with each other are severed, the multi-panel project display board may be unfolded from its folded condition. The two side panels may be pivoted each to an oblique angle relative to the central panel and positioned to stand upright in a self-standing manner. The base panel, which is loose because of the severed further perforation line, may be folded at its crease lines and attached to the central panel and the two side panels to help stabilize the project display board and provide a surface upon which items to be displayed may be placed. The integral header panel may be folded out.

BRIEF DESCRIPTION OF THE SEVERAL VIEWS OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
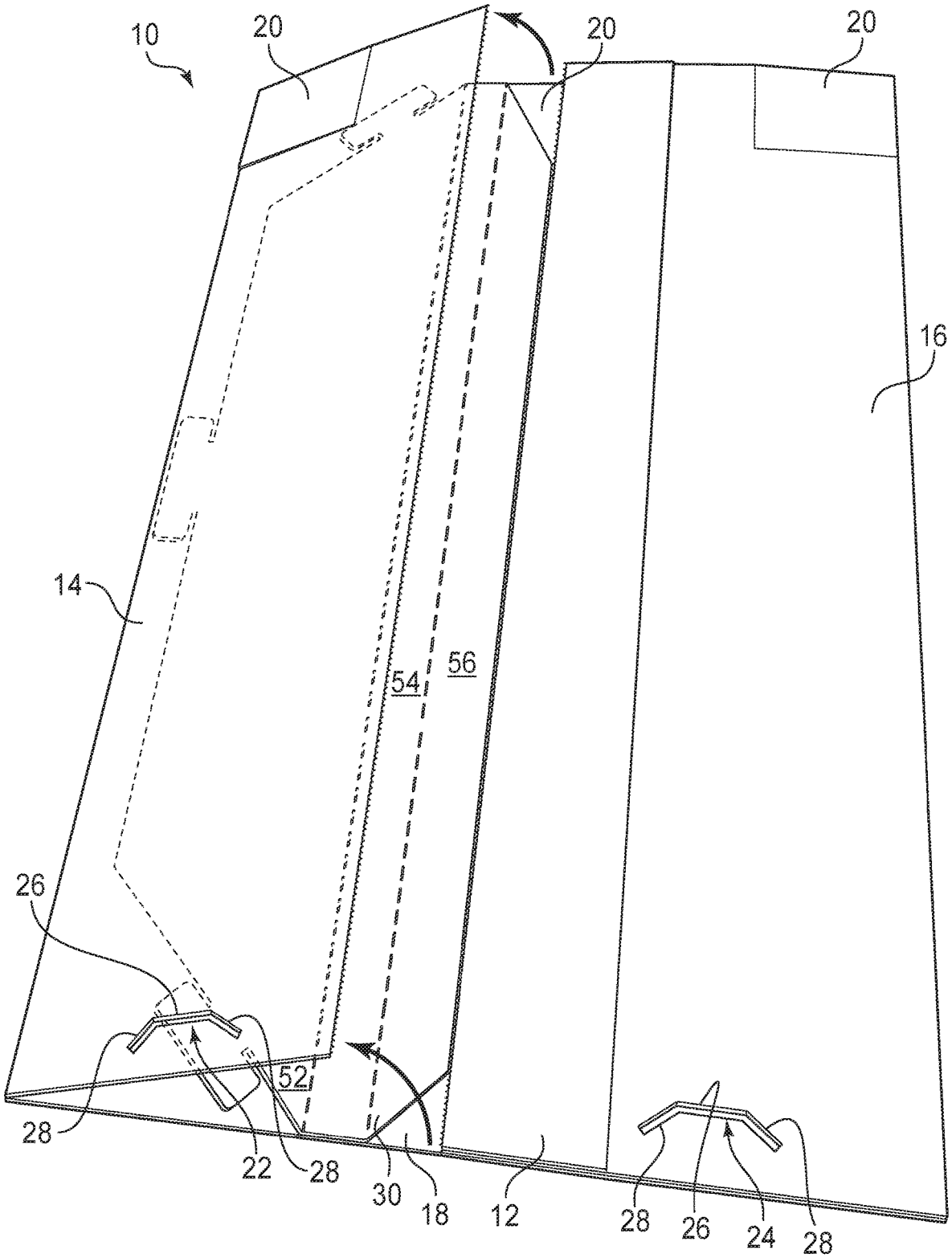
FIG. 1 is an isometric view of the multi-panel project display board of the invention with one of the side panels in a folded state and the other swung open after severing a line of perforations between one of the side panels and an adhesive panel, which is adhered to the other of the side panels.

Turning to FIG. 1, the multi-panel project display board 10 of the invention is shown in a partially open condition. The multi-panel project display board 10 has an adhesive panel 12 adhered to a side panel 16. A central panel 18 is between another side panel 14 and the side panel 16. Crease lines separate the central panel 18 from the two side panels 14, 16. An integral, fold-out header panel 20 is provided that conforms to that of the integral, fold-out header panel depicted in U.S. Pat. Nos. 10,170,024 and 10,163,378, both of whose contents are incorporated herein by reference.

There is a line of perforations that detachably couples the side panel 16 to the base 30. By severing those perforations, the multi-panel project display board 10 may be opened to the position of FIG. 2 with the base 30 free to be repositioned. Prior to realizing the orientation shown in FIG. 1, it was necessary to severe a different line of perforations that was in alignment with those that detachably couple the side panel 16 to the base 30. This different line of perforations detachably coupled the adhesive panel to the side panel 14 as can be appreciated in FIG. 1 if one were to pivot the side panel 14 down to lie adjacent the adhesive panel 12.

Once the base 30 has been freed by serving the applicable line of perforations, the base 30 may be connected to the multi-panel project display board 10 via complementary fastening components, such as via projecting inserts fitted into slots.

Figure 2:
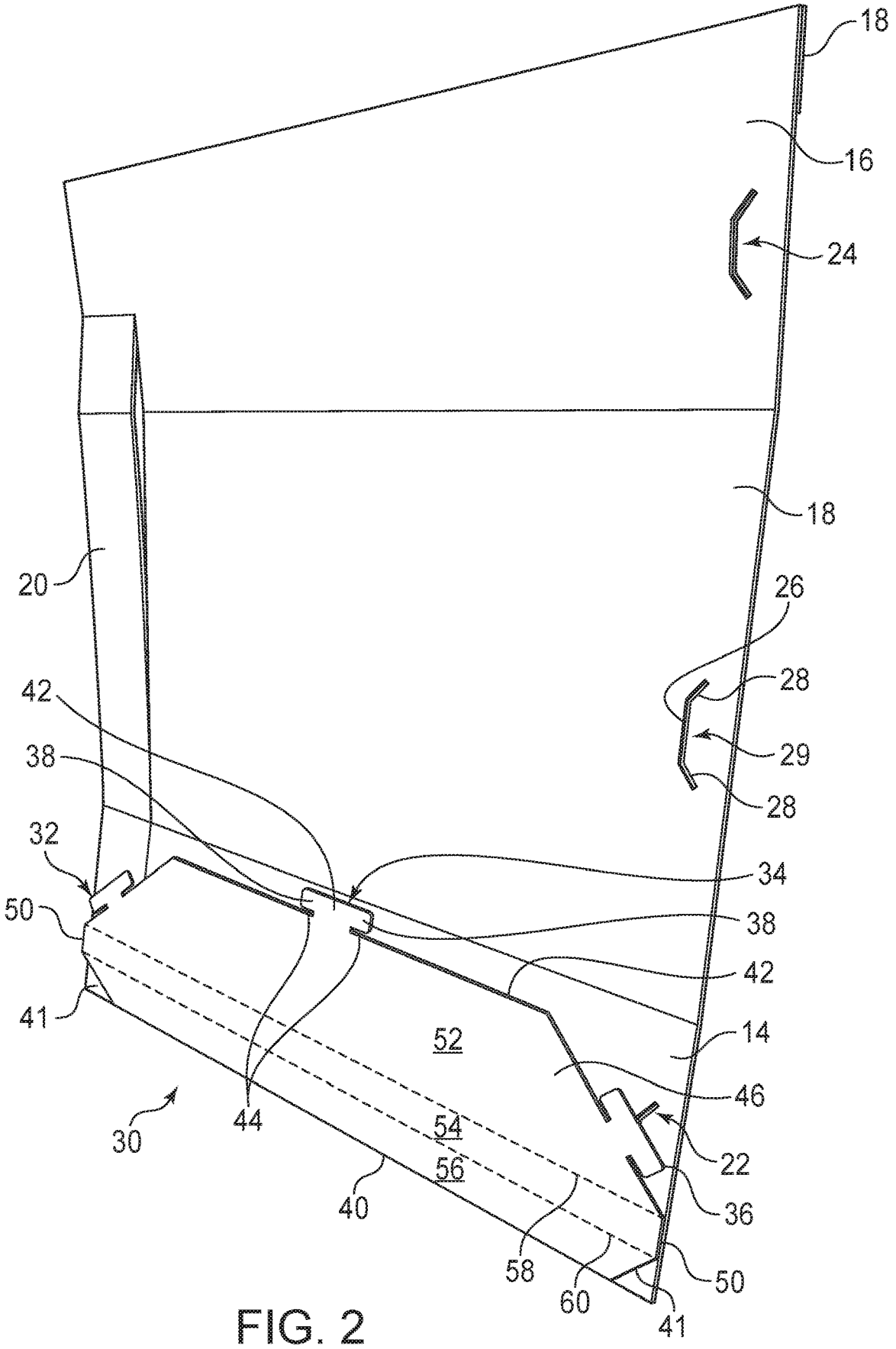
FIG. 2 is an isometric view of the multi-panel project display board of FIG. 1 in an unfolded state after severing another line of perforations between the base and the side panel to which is adhered the adhesive panel and unfolding.

With respect to FIG. 1, there is, toward the bottom of each side panel 14, 16, a respective slot 22, 24. Each slot 22, 24 has a horizontal portion 26 and two inclined portions 28 that diverge away from opposite ends of the horizontal portion 26. FIG. 2 shows the multi-panel project display board 10 in an unfolded state, which reveals another slot 29 that is identical in construction to the slots 22, 24, but is arranged toward the bottom of the central panel 18. Thus, there are three slots altogether. All surfaces when so opened that appear in FIG. 2 are preferably white such as arises with conventional white linerboard. As should be appreciated, the three slots 22, 24, 29 are at substantially the same elevation and in different ones of the three panels (central and two side).

Also shown is the base 30, which has three projecting inserts 32, 34, 36. Each of them has two wing parts 38 that extend in opposite directions from a central part 42 of the projecting inserts 32, 34, 36 and define respective gaps 44 between the two wing parts 38 and inclined peripheral edges 46 or straight peripheral edge 48 of the base 30. The three projecting inserts 32, 34, 36 project outward from respective ones of the three peripheral edges 46, 48, 46. The straight peripheral edge 50 of the base 30 separates the two inclined peripheral edges 46, 46 of the base 30. The two wing parts 38 may pivot relative to the central part 42 to fit into the three slots 22, 24, 29. Once through, the wing parts 38 may be pivoted back to help retain the base 30 to the central panel 18 and the two side panels 14, 16.

Figure 3:
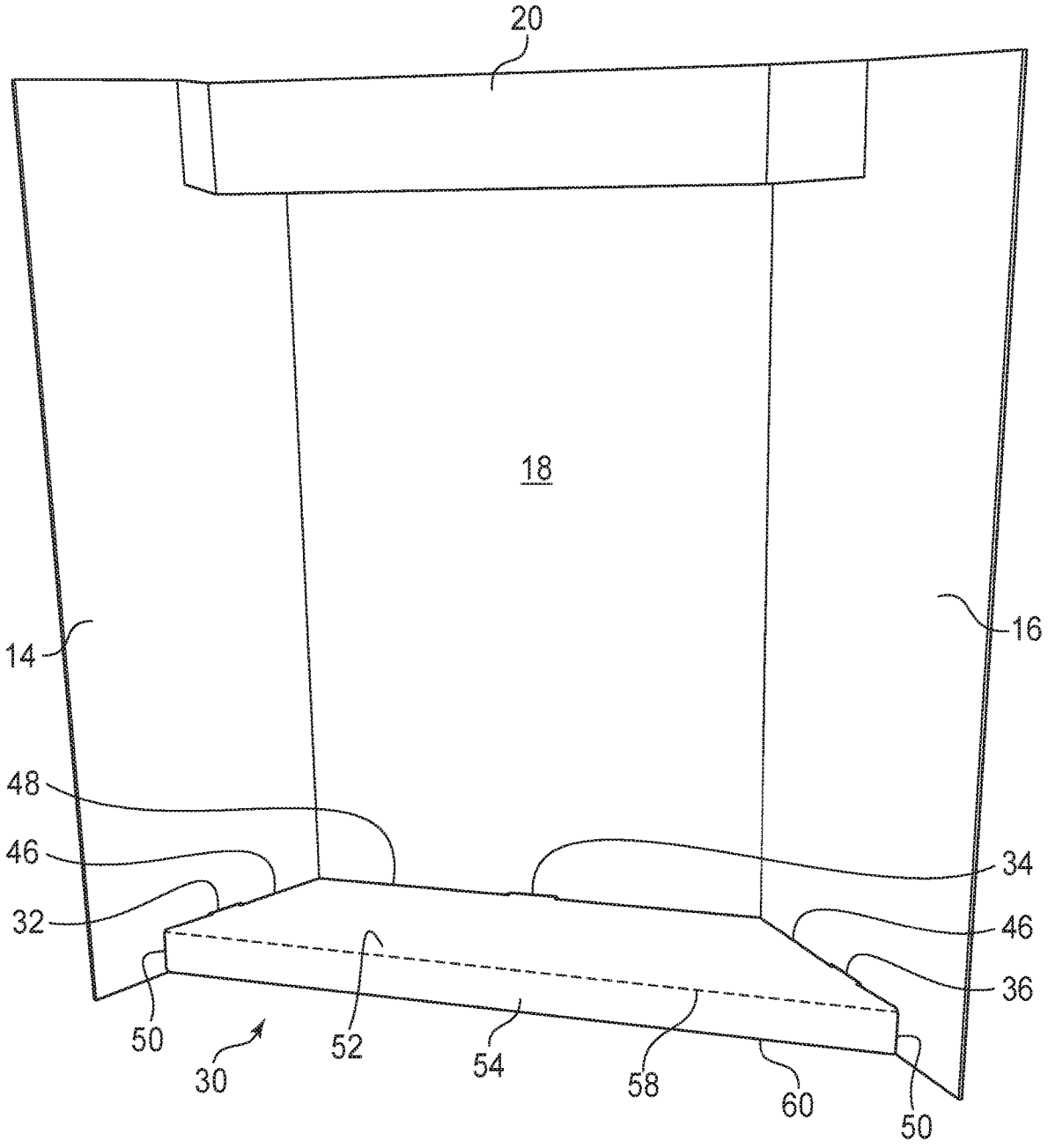
FIG. 3 is an isometric front view of the multi-panel project display board of FIGS. 1 and 2 in a fully erect portion self-standing upon a horizontal surface.

Turning to FIGS. 2 and 3, the base 30 has a top horizontal surface 52, a front vertical surface 54 and a bottom horizontal surface 56. Crease lines 58, 60 are provided that separate the front vertical surface 54 from the top horizontal surface 52 and the bottom horizontal surface 56. The bottom horizontal surface 56 extends underneath the top horizontal surface 52 when assembled in the manner of FIG. 3, although the bottom horizontal surface 56 of FIG. 2 is hidden from view in FIG. 3. The crease lines 58, 60 may be scored and crushed, rear linerboard slit, front linerboard slit, perforated or beaded, for instance. Such beaded creases are discussed more fully in U.S. patent application Ser. No. 16/115,114, whose contents regarding beaded portions that form creases is incorporated herein by reference.

The top horizontal surface 52 is bounded by a rear central edge 48, two inclined side edges 46, 46 and a front crease 58. The three projecting inserts 32, 34, 36 project outward from the rear central edge 48 and two inclined side edges 46, 46 respectively. The front vertical surface 54 is bounded at the top by the top front crease line 58 and two opposite side edges 50, 50 and a lower front crease line 60. The bottom horizontal surface 56 is bounded at the bottom by a straight edge 40 and at opposite sides by two inclined edges 41, 41 and at the top by the lower front crease line 60.

Figure 4:
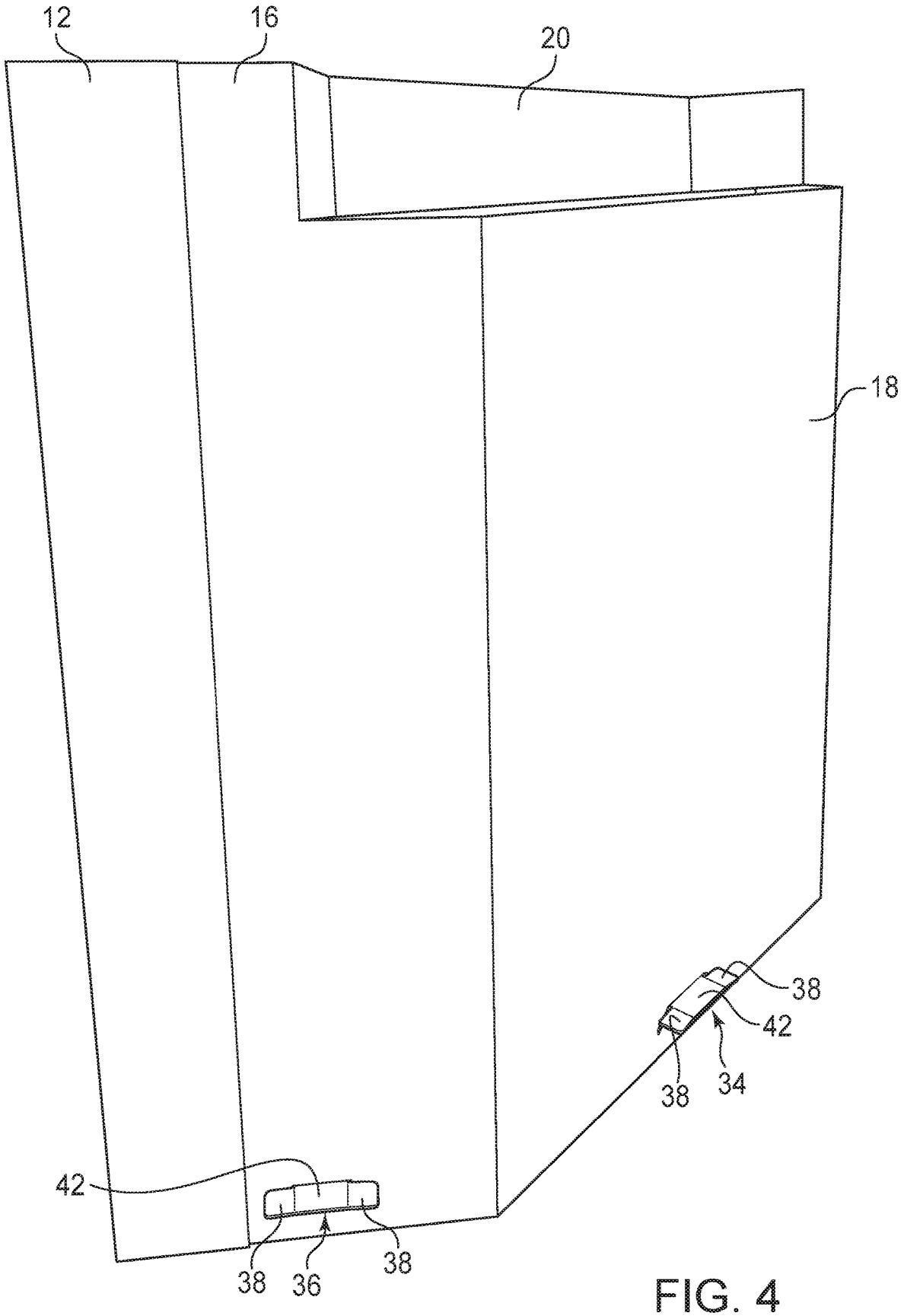
FIG. 4 is an isometric view from the right side and rear of the multi-panel project display board of FIG. 3. Such is symmetric to the view from the left side and rear.

The base 30 helps provide stability and support to the multi-panel project board 10 as well as to provide a working surface (the top horizontal surface 52) for placement of items on display. As can be appreciated from FIGS. 3 and 4, the multi-panel project display board 10 is positioned erect to self-stand upright upon a flat surface. The side panels 14, 16 are angled obliquely relative to the central panel 18 in a diverging manner.

The multi-panel project display board 10 may be formed from two linerboards spaced from each by a medium, which may be corrugated cardboard, corrugated fiberboard, corrugated paperboard, foam core and/or cork core. One of the linerboards may be mottled and other non-mottled. The mottled linerboard may be any conventional model white linerboard, whether from bleached pulp or white grades of recycled fiber. For example, GP Harmon is one supplier of a mottled white top linerboard for which the top ply (approximately 20 percent) on a white top sheet is made from bleached pulp or white grades of recycled fiber. The non-mottled linerboard may be uncoated paperboard.

All the creases may be of the same type construction or of various types of construction, such as crushed scores, rear linerboard penetrating slits, front linerboard penetrating slits, or alternating full penetrating slits on either side of beaded portions. The full penetrating slits penetrate both the front and rear linerboard, but the rear linerboard penetrating slits would not penetrate the front linerboard and the front linerboard penetrating slits would not penetrate the rear linerboard.

While the foregoing description and drawings represent the preferred embodiments of the present invention, various changes and modifications made be made without departing from the scope of the present invention.

What is claimed is:

1. A display device, comprising:

a base having two lengthwise crease lines arranged so as to divide the base into two end panels and a middle panel between the two end panels, each of the end panels being bounded by a respective pair of side edges that are inclined in a converging manner in a direction away from the middle panel and by a respective peripheral edge that extends between the side edges of the respective pair, the middle panel having a pair of opposite edges that space apart the respective pairs of side edges from each other, the two lengthwise crease lines being spaced apart from each other to bound the middle panel between the two lengthwise crease lines, the pair of opposite edges of the middle panel each being shorter than each of the two crease lines and shorter than each of the respective peripheral edges of the end panels.

2. The display device of claim 1, wherein the pair of opposite edges of the middle panel are each straight and parallel relative to each other.

3. The display device of claim 1, wherein the respective peripheral edge of each of the end panels is straight.

4. The display device of claim 1, further comprising:

at least one projecting insert extending outward from the respective peripheral edge of at least one of the end panels.

5. The display device of claim 4, wherein the projecting insert includes a central part and two wing parts that extend in opposite directions from the central part, the two wing parts each being bendable relative to the central part.

6. The display device of claim 1, further comprising:

a project display board having a central panel separating two side panels by respective crease lines, one of the peripheral edges of the base being detachably connected to one of the two side panels of the project display board via perforations.

7. The display device of claim 6, wherein the project display board has an adhesive panel adhered to one of the two side panels, a remaining one of the two side panels of the project display board being detachably connected to the adhesive panel via perforations.

8. The display device of claim 6, wherein the project display board includes an integral header panel with header panel creases, the integral header panel being movable relative to the central panel between a deployed position and an non-deployed position by bending at the header panel creases so that in the deployed position, the header panel extends over the base when the project display board is self-standing in an upright manner.

9. The display device of claim 1, further comprising:

a project display board having a central panel separating two side panels by respective crease lines, the base panel being connected to each of the central panel and the two side panels of the project display board, the base being folded at the two lengthwise crease lines of the base so that the two end panels of the base extend parallel to each other and the middle panel extends perpendicular to the two end panels.

10. The display device of claim 9, wherein the project display board and the base are connected to each other by insertion of at least one projecting insert into at least one slot.

11. The display device of claim 10, wherein the at least one slot includes a plurality of slots and the at least one projecting insert including a plurality of inserts, the plurality of inserts being simultaneously inserted into respective ones of the plurality of slots that are in alignment with each other.

12. The display device of claim 10, wherein the at least one slot has a central portion and two diverging portions, the two diverging portions extending outwardly away from ends of the central portion in a diverging manner.

13. The display device of claim 10, wherein the at least one projecting insert includes a central part and two wing parts that extend in opposite directions from the central part, the two wing parts each being bendable relative to the central part to fit in alignment through the at least one slot.

14. A display device, comprising:

a base having two crease lines arranged so as to divide the base into two end panels and a middle panel between the two end panels, each of the end panels being bounded by a respective pair of side edges that are inclined in a converging manner in a direction away from the middle panel and by a respective peripheral edge that extends between the side edges of the respective pair, the middle panel having a pair of opposite edges that space apart the respective pairs of side edges from each other, wherein the base is folded at each of the crease lines so that the two end panels are arranged with one over the other in a spaced apart manner, further comprising:

a project display board having a central panel separating two side panels by respective crease lines all arranged in a self-standing upright manner, the base being arranged so as to neighbor the central panel and the two side panels.

15. A display device, comprising:

a project display board having a central panel separating two side panels by respective crease lines and being folded at the respective crease lines, the project display board also having an adhesive panel adhered to an initial one of the two side panels, a remaining one of the two side panels being detachably connected to the adhesive panel via perforations; and a base detachably connected to the initial one of the two side panels via perforations, the base having two lengthwise crease lines spaced apart from each other to bound a middle panel of the base between the two lengthwise crease lines so that the middle panel is between two end panels of the base, each of the two end panels having two side edges that incline to converge away from a pair of opposite edges of the middle panel and having respective peripheral edges that separate the two side edges of respective ones of the end panels, the pair of opposite edges of the middle panel each being shorter lengthwise than each of the two lengthwise crease lines and shorter than each of the respective peripheral edges of the end panels.

16. The display device of claim 15, wherein the perforations between the remaining one of the two side panels and the adhesive panel and the perforations between the initial one of the two side panels and the base are in alignment with each other.

17. The display device of claim 15, wherein the project display board includes an integral header panel with header panel creases, the integral header panel being movable relative to the central panel between a deployed position and an non-deployed position by bending at the header panel creases after detaching the two side panels.

18. A method of assembly of a project display board with base, comprising the steps of:

severing perforations between an adhesive panel and one of two side panels of a project display board, the adhesive panel adhering to a remaining one of the two side panels;

severing perforations between a base and the remaining one of the two side panels;

unfolding the two side panels relative to a central panel of the project display board to stand the project display board upright in a self-standing manner;

folding the base along creases in the base so as to elevate a surface of the base relative to other surfaces of the base; and positioning the base to neighbor the central panel of the project display board with the side panels of the project display board flanking the base.

19. The method of claim 18, further comprising:

connecting the base to the project display board via insertion of projecting inserts into slots in secure manner.

* * * * *